US010774584B2

(12) United States Patent
Siebenaller et al.

(10) Patent No.: US 10,774,584 B2
(45) Date of Patent: Sep. 15, 2020

(54) BATTENED ROLLER COVERING

(71) Applicant: Hunter Douglas, Inc., Pearl River, NY (US)

(72) Inventors: Michael J. Siebenaller, Broomfield, CO (US); Kevin Dann, Broomfield, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 327 days.

(21) Appl. No.: 15/947,954

(22) Filed: Apr. 9, 2018

(65) Prior Publication Data

US 2018/0298685 A1 Oct. 18, 2018

Related U.S. Application Data

(60) Provisional application No. 62/485,028, filed on Apr. 13, 2017.

(51) Int. Cl.
*E06B 9/388* (2006.01)
*E06B 9/42* (2006.01)
(Continued)

(52) U.S. Cl.
CPC ..... *E06B 9/388* (2013.01); *E06B 9/24* (2013.01); *E06B 9/42* (2013.01); *A47H 23/04* (2013.01);
(Continued)

(58) Field of Classification Search
CPC ... E06B 9/24; E06B 9/388; E06B 9/42; E06B 2009/2482; E06B 2009/2441; E06B 2009/135; A47H 23/04
See application file for complete search history.

(56) References Cited

U.S. PATENT DOCUMENTS 2,594,624 A * 4/1952 Dubinsky ..... A47H 23/02 160/123
2,609,043 A 9/1952 Dubinsky
(Continued)

FOREIGN PATENT DOCUMENTS

AT 507920 A2 9/2010
AU 2015377362 A1 7/2016
(Continued)

OTHER PUBLICATIONS

EP Search Report from EP18166869.0, dated Aug. 27, 2018, 10 pages.

*Primary Examiner* — Katherine W Mitchell
*Assistant Examiner* — Abe Massad

(57) ABSTRACT

A covering for an architectural-structure covering is disclosed. The covering is formed from a plurality of assembled strips of fabric material joined together. Each assembled strip of fabric material may include a fabric material including inner and outer surfaces, and top and bottom ends. A first slat may be coupled to the inner surface of the fabric material adjacent the top end thereof, the first slat having a first contact surface. A second slat may be coupled to the outer surface of the fabric material adjacent the bottom end thereof, the second slat having a second contact surface. The first contact surface of the first slat of a first assembled strip is preferably nested with the second contact surface of the second slat of an adjoining second assembled strip. The second contact surface of the second slat may be partially covered by the piece of fabric material.

13 Claims, 11 Drawing Sheets

(51) Int. Cl.
*E06B 9/24* (2006.01)
*A47H 23/04* (2006.01)

(52) U.S. Cl.
CPC ..... *E06B 2009/2441* (2013.01); *E06B 2009/2482* (2013.01)

(56) References Cited

U.S. PATENT DOCUMENTS

| | | | | |
|---|---|---|---|---|
| 3,292,685 | A | 12/1966 | Clark | |
| 4,452,294 | A * | 6/1984 | Fukuchi | A47H 23/01 160/384 |
| 4,736,785 | A * | 4/1988 | Seuster | E06B 9/13 160/229.1 |
| 4,800,946 | A | 1/1989 | Rosenoy | |
| 4,824,505 | A * | 4/1989 | Kraeutler | B29C 66/4722 156/227 |
| 4,825,921 | A | 5/1989 | Rigter | |
| 5,099,905 | A | 3/1992 | Rigter | |
| 5,123,473 | A | 6/1992 | Henkenjohann | |
| 5,273,096 | A * | 12/1993 | Thomsen | E06B 9/262 160/264 |
| 5,307,859 | A * | 5/1994 | Kraeutler | E06B 9/13 160/264 |
| 5,341,864 | A * | 8/1994 | Rupel | E06B 9/24 160/134 |
| 5,355,928 | A * | 10/1994 | Robertson | E06B 9/262 160/348 |
| 5,443,563 | A | 8/1995 | Hindel et al. | |
| 5,490,553 | A | 2/1996 | Colson et al. | |
| 5,620,040 | A | 4/1997 | Swanner | |
| 5,626,177 | A | 5/1997 | Colson et al. | |
| 5,749,404 | A | 5/1998 | Colson | |
| 5,791,392 | A | 8/1998 | Fernandez Lopez | |
| 5,853,039 | A | 12/1998 | Fraser et al. | |
| 5,876,545 | A | 3/1999 | Swiszcz et al. | |
| 6,015,184 | A | 1/2000 | Ewing et al. | |
| 6,102,482 | A | 8/2000 | Dettoni et al. | |
| 6,116,319 | A | 9/2000 | Simon | |
| 6,161,893 | A | 12/2000 | Ewing et al. | |
| 6,164,363 | A | 12/2000 | Colson et al. | |
| 6,170,548 | B1 | 1/2001 | Swiszcz et al. | |
| 6,302,982 | B1 | 10/2001 | Corey et al. | |
| 6,478,905 | B2 | 11/2002 | Swiszcz et al. | |
| 6,598,650 | B1 | 7/2003 | Palmer | |
| 6,761,782 | B2 | 7/2004 | Swiszcz et al. | |
| 7,686,062 | B1 * | 3/2010 | Darnell | A47H 21/00 160/123 |
| D677,095 | S | 3/2013 | Robbins, III et al. | |
| 8,408,274 | B2 | 4/2013 | Dwarka | |
| 8,617,662 | B2 | 12/2013 | Yu | |
| 8,757,239 | B2 | 6/2014 | Colson et al. | |
| 8,851,146 | B2 | 10/2014 | Dwarka | |
| 9,359,813 | B2 | 6/2016 | Colson | |
| 9,366,080 | B2 | 6/2016 | Colson | |
| 9,366,081 | B2 | 6/2016 | Howie | |
| 9,458,663 | B2 | 10/2016 | Colson et al. | |
| 9,540,874 | B2 | 1/2017 | Colson et al. | |
| 2009/0008045 | A1 | 1/2009 | Semeels | |
| 2011/0180219 | A1 | 7/2011 | Pereira et al. | |
| 2013/0240132 | A1 | 9/2013 | Chen | |
| 2014/0034251 | A1 | 2/2014 | Colson et al. | |
| 2014/0053989 | A1 | 2/2014 | Colson et al. | |
| 2015/0122428 | A1 | 5/2015 | Van Rooij et al. | |
| 2015/0252614 | A1 * | 9/2015 | Diamond | E06B 9/44 160/108 |
| 2016/0145938 | A1 | 5/2016 | Colson et al. | |
| 2016/0152125 | A1 | 6/2016 | Van Boxtel | |
| 2016/0290040 | A1 | 10/2016 | Colson | |
| 2016/0354972 | A1 | 12/2016 | Colson et al. | |
| 2016/0356080 | A1 | 12/2016 | Colson et al. | |
| 2016/0376836 | A1 | 12/2016 | Cheng | |
| 2017/0016275 | A1 | 1/2017 | Colson | |
| 2017/0247941 | A1 | 8/2017 | Colson | |
| 2017/0354285 | A1 | 12/2017 | Kim | |

FOREIGN PATENT DOCUMENTS

| | | | |
|---|---|---|---|
| AU | 2016102074 | B4 | 1/2017 |
| CA | 2561777 | A1 | 4/2007 |
| CA | 2544933 | A1 | 8/2007 |
| DE | 3536189 | A1 | 4/1987 |
| DE | 3912528 | A1 | 10/1990 |
| DE | 202010014229 | U1 | 3/2011 |
| EP | 0379242 | A1 | 7/1990 |
| EP | 0818601 | A1 | 1/1998 |
| EP | 0948698 | B1 | 10/1999 |
| EP | 0948699 | B1 | 10/1999 |
| EP | 1048817 | B1 | 11/2000 |
| EP | 1249572 | B1 | 10/2002 |
| EP | 1681431 | B1 | 7/2006 |
| EP | 1769958 | B1 | 4/2007 |
| IE | 202010014267 | U1 | 1/2011 |
| KR | 100790026 | B1 | 1/2008 |
| KR | 200442901 | Y1 | 12/2008 |
| KR | 100908508 | B1 | 7/2009 |
| KR | 20120006912 | U | 10/2012 |
| WO | 1998019038 | A1 | 5/1998 |
| WO | 1998020225 | A1 | 5/1998 |
| WO | 2006058941 | A1 | 6/2006 |
| WO | 2006098555 | A1 | 9/2006 |
| WO | 2007036266 | A1 | 4/2007 |

* cited by examiner

BATTENED ROLLER COVERING

CROSS-REFERENCE TO RELATED APPLICATIONS

This is a non-provisional of U.S. provisional patent application Ser. No. 62/485,028, filed Apr. 13, 2017, titled "Battened Roller Covering," the entirety of which application is incorporated by reference herein.

FIELD OF THE DISCLOSURE

The present disclosure relates generally to the field of architectural-structure coverings, and relates more particularly to a covering for use in an architectural-structure covering, the covering being manufactured from a plurality of assembled strips of material.

BACKGROUND

Architectural-structure coverings may selectively cover a window, a doorway, a skylight, a hallway, a portion of a wall, etc. Horizontal architectural-structure coverings may come in a variety of configurations. One common type of architectural-structure covering is a roller-type architectural-structure covering. Roller-type architectural-structure coverings manufactured from fabric, especially delicate fabrics, present several challenges that need to be addressed. For example, in the retracted position, fabrics may become big and bulky thus resulting in a larger diameter of material about a horizontally-oriented roller tube that users may desire to conceal by, for example, a head rail. In addition, delicate fabrics are often only available in certain dimensions, for example, delicate fabrics are often only available in widths up to about 54", thus prohibiting their use in windows having greater widths. Moreover, if the fabric has a defect or becomes damaged in any way during manufacturing, the fabric is often discarded in its entirety resulting in potentially significant monetary cost and waste. In addition, delicate fabrics tend to wrinkle, particularly as the width of the fabrics increases.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an improved covering for use in an architectural-structure covering. The architectural-structure covering may include a covering extending between a head rail and a bottom rail. The covering may be formed from a plurality of assembled strips of fabric material joined together. Each assembled strip of fabric material may include a fabric material including inner (e.g., room facing) and outer (e.g., window or wall facing) surfaces, and top and bottom ends. A first slat may be coupled to the inner surface of the fabric material adjacent to the top end thereof, the first slat having a first contact surface. A second slat may be coupled to the outer surface of the fabric material adjacent to the bottom end thereof, the second slat having a second contact surface. The first contact surface of the first slat of a first assembled strip of fabric material may be nested with the second contact surface of the second slat of an adjoining second assembled strip of fabric material, and vice-versa. That is, the first slat may be coupled to the inner surface of the fabric material, the second slat may be coupled to the outer surface of the fabric material, and the contact surface of the second slat may be nested with the contact surface of the first slat of an adjoining second assembled strip of fabric material. As such, an outer surface (e.g., window or wall facing) of the first slat may be coupled to the inner surface (e.g., room facing) of the fabric material, an inner surface (e.g., room facing) of the second slat may be coupled to the outer surface (e.g., window or wall facing) of the fabric material to form an assembled strip of fabric material. Thereafter, two or more assembled strips of fabric material may be coupled together to form the covering of the architectural-structure covering. For example, an inner surface (e.g., room facing) of the first slat may be coupled to an outer surface (e.g., window or wall facing) of an adjoining second assembled strip of fabric material.

The present disclosure may also be directed to an assembled strip of material for use in producing an architectural-structure covering. The assembled strip of material including a fabric material including an inner surface, an outer surface, a top end, a bottom end, a first side edge, and a second side edge. A first slat may be coupled to the inner surface of the fabric material adjacent the top end thereof, the first slat having a first contact surface. A second slat may be coupled to the outer surface of the fabric material adjacent the bottom end thereof, the second slat having a second contact surface configured to contact the first contact surface of an adjacent assembled strip. The second slat may be at least partially wrapped by the fabric material thus forming a surface at least partially covered by the fabric material, a remaining, non-covered portion of the surface defining the second contact surface. The first and second slats preferably each include an arcuate shape.

DETAILED DESCRIPTION

Figure 1:
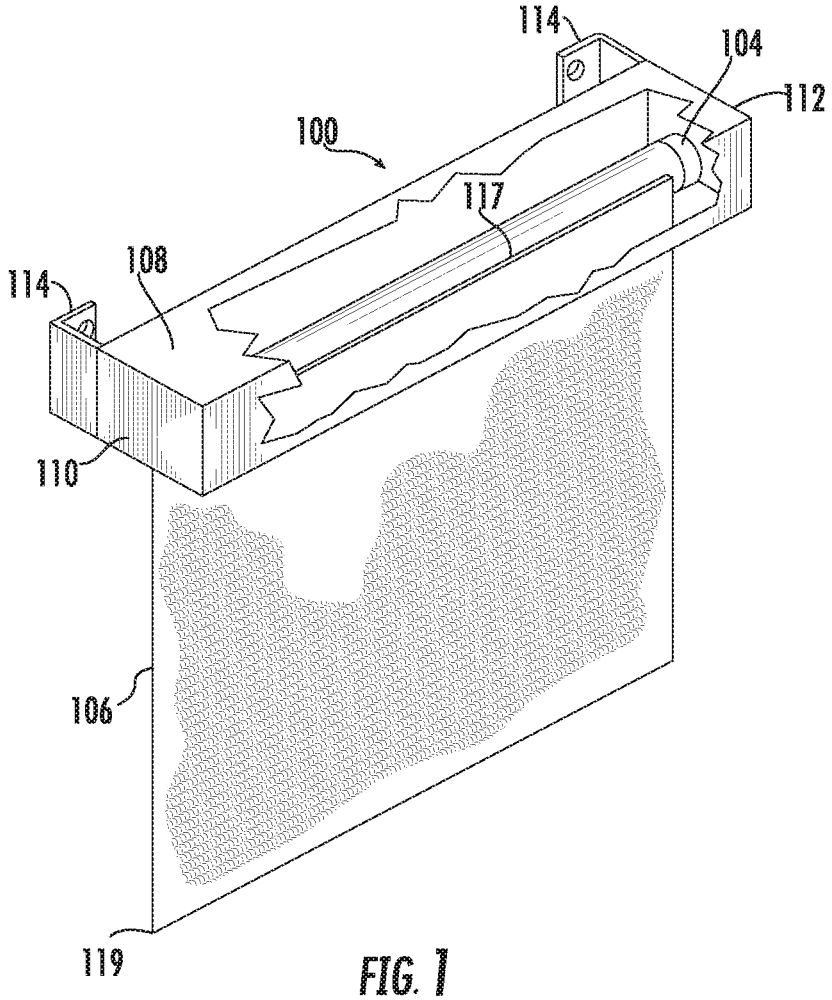
FIG. 1 PRIOR ART
FIG. 1 is front perspective view illustrating an example embodiment of an architectural-structure covering assembly including a covering shown in an extended position.

Embodiments of a covering in accordance with the present disclosure will now be described more fully hereinafter with reference to the accompanying drawings, in which preferred embodiments of the present disclosure are presented. The covering of the present disclosure may, however, be embodied in many different forms and should not be construed as being limited to the embodiments set forth herein. Rather, these embodiments are provided so that this disclosure will convey certain example aspects of the covering to those skilled in the art. In the drawings, like numbers refer to like elements throughout unless otherwise noted.

As will be described in greater detail below, the covering of the present disclosure may be used in connection with an architectural-structure covering, for example, a roller-type architectural-structure covering, as shown in FIG. 1. The covering may be made via a strip process utilizing fabric strips and curved slats nested together in a process that preferably allows for the covering to be made with production-on-demand type equipment. That is, the covering may be made by joining assembled strips of fabric material together. Each assembled strip of fabric material including first and second slats extending widthwise, on either side (e.g., top and bottom) of a piece of material. In use, the slats are preferably configured so that when assembled strips of fabric material are joined together, a slat in a first assembled strip of fabric material is nested with a slat of a second, adjoining assembled strip of fabric material. When rolled about a proper dimensioned roller tube, the nested pair of slats may be arranged along the height of the covering to become offset with respect to one another, thereby allowing the covering to retract into a smaller envelope enabling, inter alia, longer fabric coverings to be retracted in a given space than achievable without such offset.

In addition, utilizing a covering according to the present disclosure allows for the covering to be made in an on-demand fashion and to facilitate incorporation of fabrics that are not readily available in larger sizes or that are generally too soft or too flexible to be used to make larger coverings. That is, by using a strip method of fabrication, material that is normally not readily available in larger widths (e.g., widths greater than about 54") can be utilized by re-orientating the material so that the fabric material may be cut from a roll of material (e.g., transverse to the direction that the material is rolled/unrolled) to any desired length, which is sized to extend across (e.g., width) the covering. The length (e.g., height) of the covering may then be customizable by increasing or decreasing the number of assembled strips assembled or arranged (e.g., joined) together, or by varying the height of each assembled strip. In this manner, the previous limitation is alleviated, and the use of delicate materials (or the like, which fabrics may require additional support when extending across an unsupported area) in covering manufacturing are readily available to use in coverings having greater widths.

In one embodiment, a covering for an architectural-structure covering includes a plurality of assembled strips of fabric material joined together. Each assembled strip of fabric material includes a fabric material, a first slat, and a second slat. The fabric material includes an inner surface, an outer surface, a top end, a bottom end, a first side edge, and a second side edge. The first slat may be coupled to the inner surface of the fabric material adjacent the top end thereof. The second slat may be coupled to the outer surface of the fabric material adjacent the bottom end thereof. The first slat has a first contact surface and the second slat has a second contact surface. The first contact surface of the first slat of a first assembled strip of fabric material is nested with the second contact surface of the second slat of an adjoining second assembled strip of fabric material to form an assembled covering (e.g., shade).

In another embodiment, an assembled strip of material for use in producing an architectural-structure covering is disclosed. The assembled strip of material includes a fabric material, a first slat, and a second slat. The fabric material includes an inner surface, an outer surface, a top end, a bottom end, a first side edge, and a second side edge. The first slat may be coupled to the inner surface of the fabric material adjacent the top end thereof. The second slat may be coupled to the outer surface of the fabric material adjacent the bottom end thereof. The first slat has a first contact surface and the second slat includes a second contact surface configured to contact the first contact surface of an adjacent assembled strip. Each of the first slats may have a width $W_1$ (e.g., height of the first slat) and each of the second slats may have a width $W_2$ (e.g., height of the second slat), $W_2$ being larger than $W_1$.

Referring to FIG. 1, a front view of an example architectural-structure covering 100 is shown. As shown, the architectural-structure covering assembly 100 can include a headrail 108, which in the illustrated embodiment is a housing having opposed end caps 110, 112 joined by front, back, and top sides to form an open bottom enclosure. The headrail 108 may include mounts 114 for mounting the architectural-structure covering assembly 100 to a wall or other structure. Although a particular example of a headrail 108 is shown in FIG. 1, many different types and styles of headrails exist and could be employed in place of the example headrail of FIG. 1.

The architectural-structure covering assembly 100 may also include a roller tube 104 rotatably coupled between the end caps 110, 112, and a covering 106. In the illustrated example, the covering 106 has an upper edge 117 mounted to the roller tube 104 and a lower, free edge 119. As will be readily appreciated by one of ordinary skill in the art, the covering 106 of the architectural-structure covering 100 may be suspended from the roller tube 104 and may be configured to be vertically extended and retracted relative to the head rail 108 between an extended position (shown in FIG. 1), wherein the covering 106 may partially or entirely cover a window, a doorway, a skylight, a hallway, a portion of a wall, etc., and a retracted position, wherein the covering 106 may be retracted into, and substantially hidden within, the head rail 108 (e.g., behind a fascia of the head rail). Although not shown, an appropriate known or heretofore to be developed drive mechanism can be provided to move the covering 106 between the extended and retracted positions. In addition, the present disclosure is not limited to a particular roll-up direction, and the architecture structure covering assembly 100 may be configured to operate in a conventional manner, or in a reverse-roll-up.

Referring to FIG. 1, for the sake of convenience and clarity, terms such as "front," "rear," "top," "bottom," "up," "down," "vertical," "horizontal", "inner," and "outer" may be used herein to describe the relative placement and orientation of various components and portions of the architectural-structure covering 100, each with respect to the geometry and orientation of the architectural-structure covering 100 as they appear in FIG. 1. Said terminology will include the words specifically mentioned, derivatives thereof, and words of similar import.

Figure 2:
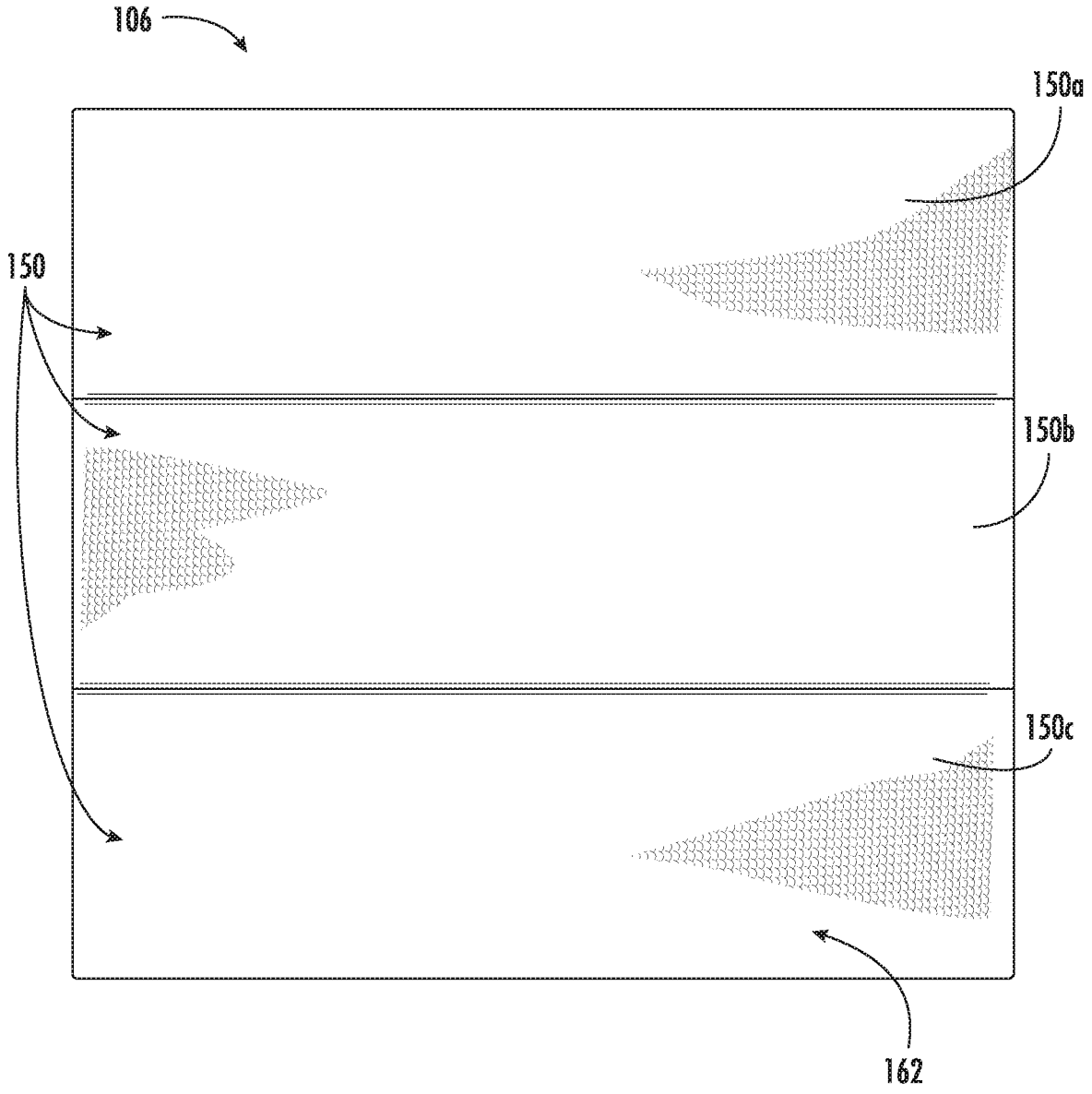
FIG. 2 is a front plan view illustrating an example embodiment of a covering in accordance with an illustrative embodiment of the present disclosure.

Referring now to FIG. 2, a covering 106 according to an example embodiment of the present disclosure will now be described. As shown, in accordance with an illustrative, non-limiting embodiment of the present disclosure, the covering 106 may be manufactured from a plurality of joined assembled strips of fabric material 150 (hereinafter "assembled strips"). The assembled strips 150 and hence the covering 106 may be constructed of a fabric material. However, it will be understood that the assembled strips 150 and hence the covering 106 may be constructed from any type of material. For example, the assembled strips 150 and hence the covering 106 may be constructed from a plastic material, a vinyl material, etc.

Figure 3:
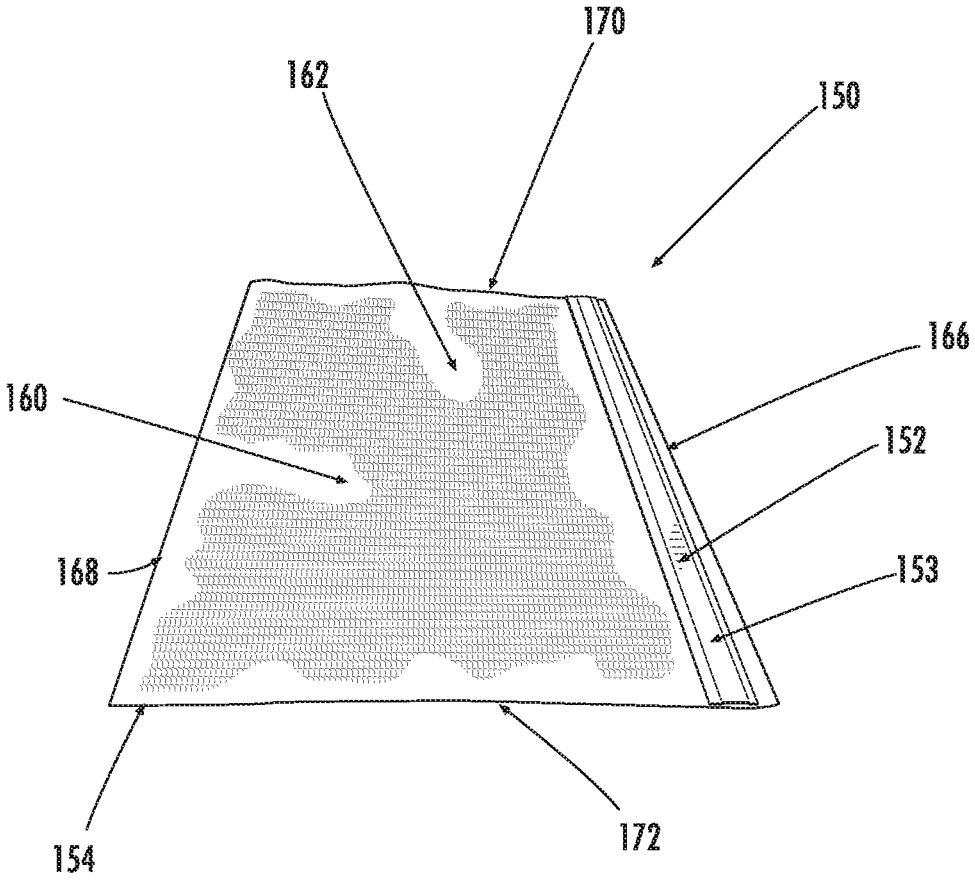
FIG. 3 is a back, perspective view illustrating an example embodiment of an assembled strip used to produce the covering shown in FIG. 2.
Figure 4:
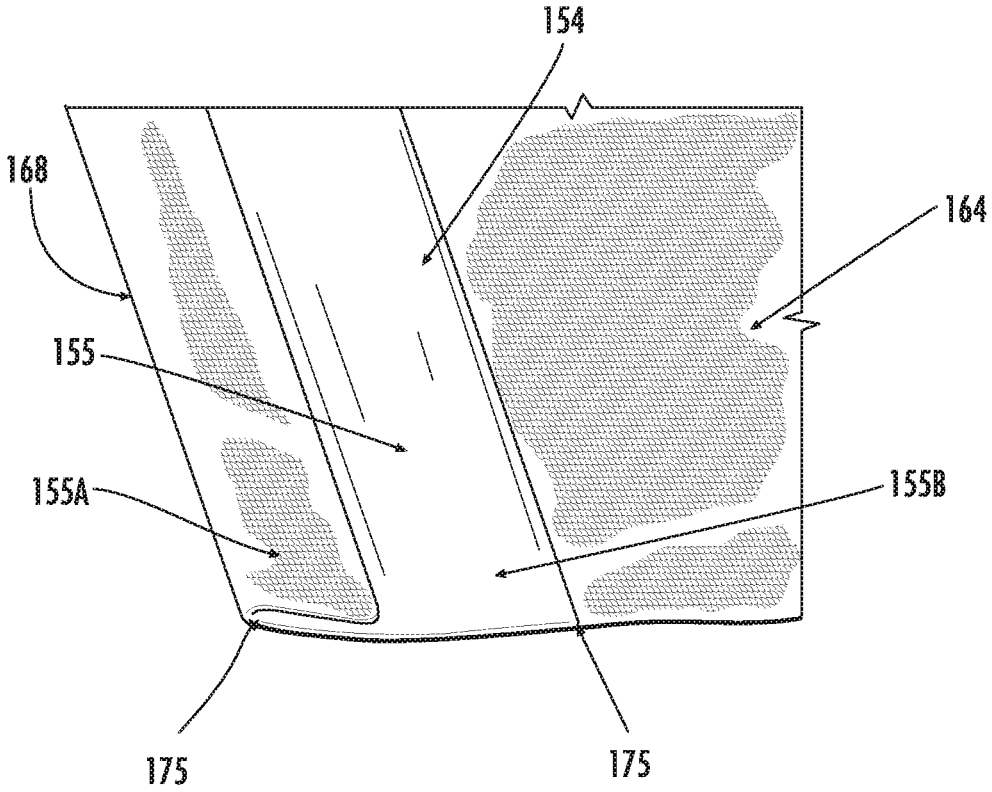
FIG. 4 is a side, back view of a partially wrapped slat used to produce the assembled strip shown in FIG. 3.
Figure 5:
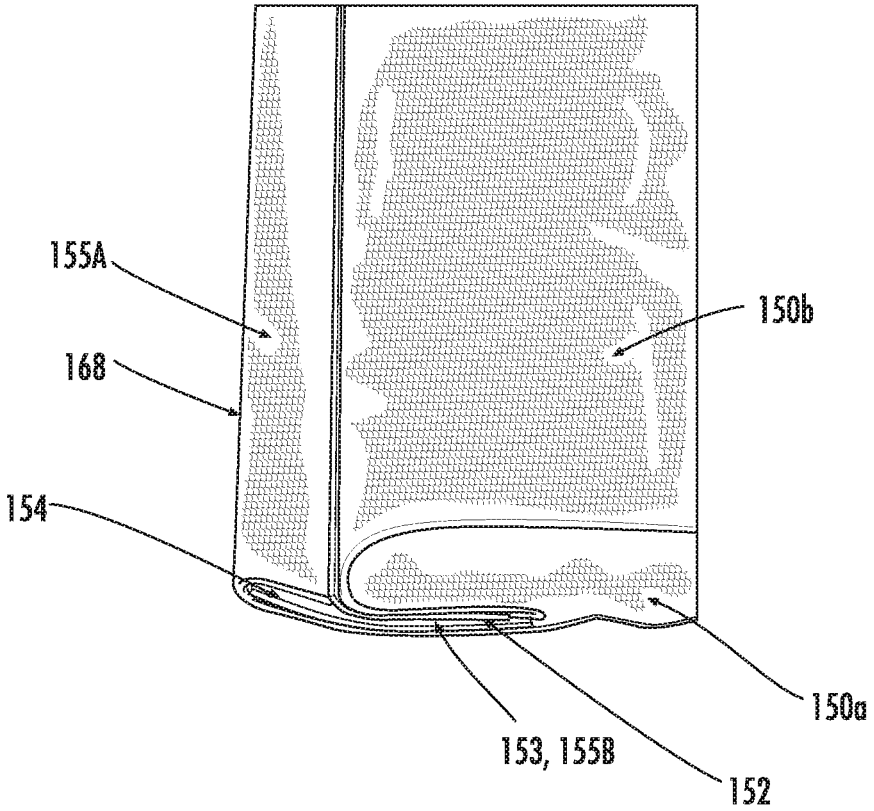
FIG. 5 is a front view illustrating the coupling of adjacent assembled strips used to produce the covering shown in FIG. 2.
Figure 6:
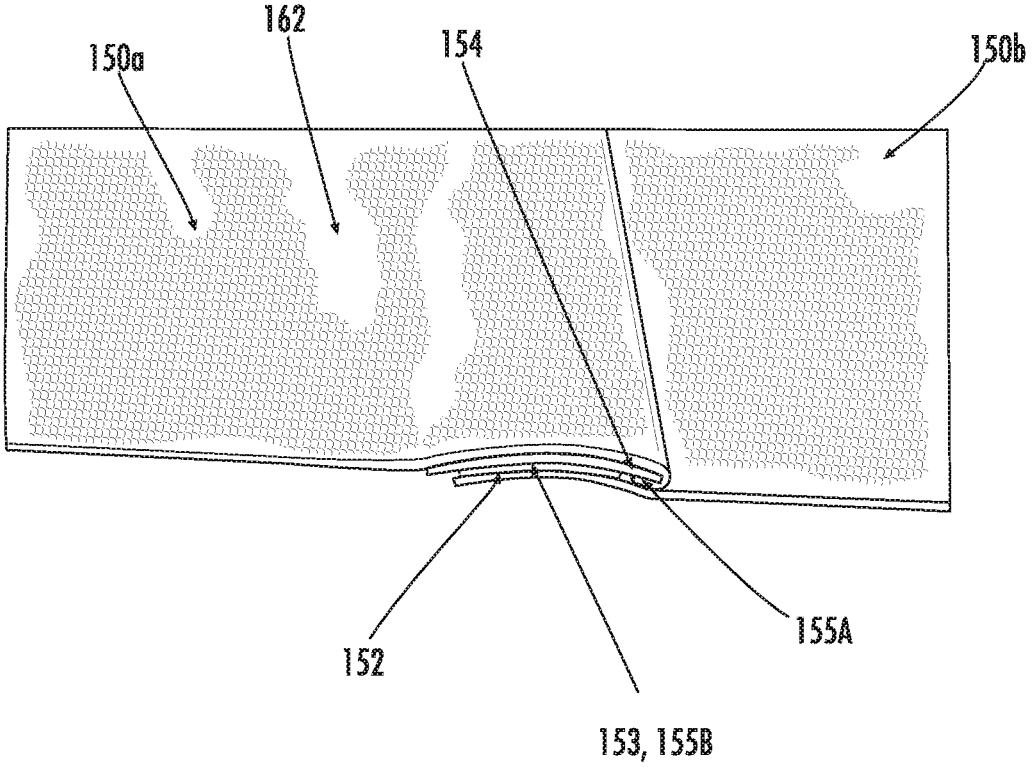
FIG. 6 is a side, front view illustrating the coupling of adjacent assembled strips used to produce the covering shown in FIG. 2.
Figure 7:
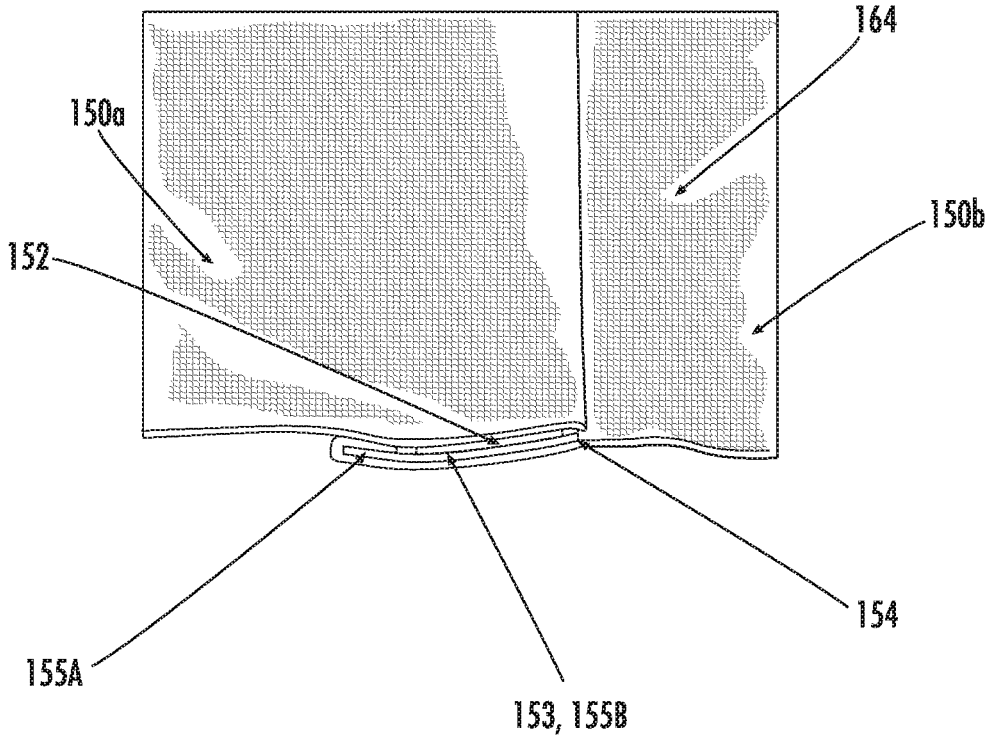
FIG. 7 is a side, back bottom view illustrating the coupling of adjacent assembled strips used to produce the covering shown in FIG. 2.

Referring to FIG. 2, in accordance with the present disclosure, the covering 106 may be manufactured from a plurality of assembled strips 150, for example, first, second, and third assembled strips 150*a*, 150*b*, 150*c*. It will be understood that the number of assembled strips 150 can be varied depending on the required length (e.g., top to bottom) of the covering 106. For example, the covering can be made of more or fewer assembled strips 150 to achieve a longer or shorter covering 106. Referring to FIG. 3, each assembled strip 150 includes a first slat 152 and a second slat 154 on either side of an intermediate piece of material 160. As shown, the intermediate piece of material 160 may include an inner surface (e.g., room facing) 162 (FIG. 2), an outer surface (e.g., window or wall facing) 164 (FIG. 4), a top end 166, a bottom end 168, a first side edge 170, and a second side edge 172. The first slat 152 may be coupled to (e.g., associated with, attached, affixed, secured, engaged, connected, etc. collectively referred to herein as "coupled" without the intent to limit) the intermediate piece of material 160 adjacent the top end 166 thereof while the second slat 154 may be coupled to the intermediate piece of material 160 adjacent the bottom end 168, or vice-versa. The first slat 152 may be coupled to the inner surface 162, while the second slat 154 may be coupled to the outer surface 164, or vice-versa. As such, in one illustrative embodiment, the first and second slats 152, 154 are coupled to the intermediate piece of material 160 on opposite inner and outer surfaces 162, 164 thereof, respectively. The first and second slats 152, 154 may extend widthwise along the intermediate piece of material 160 from the first side edge 170 to the second side edge 172 thereof, although it is envisioned that the slats 152, 154 may not extend the entire length or that multiple smaller pieces of slats may be used instead of a single slat.

In one embodiment, the intermediate piece of material 160 may be a fabric material. The intermediate piece of material 160 may be referred to herein as an intermediate fabric material or a fabric material without the intent to limit. As will be described in greater detail below, in use, the first and second slats 152, 154 may function as stiffening members. That is, the first and second slats 152, 154 may stiffen the intermediate piece of material 160 to prevent or substantially prevent the intermediate piece of material 160 from wrinkling when the intermediate piece of material 160 is extended from the roller tube 104. The slats 152, 154 may be manufactured from any appropriate material known in the art including, but not limited to, a polycarbonate or nonwoven material, a moldable Polyethylene terephthalate (PETG) film, a plastic material, a metal material such as, for example, aluminum, etc. As will be described in greater detail below, the slats 152, 154 may have any shape, for example, flat or substantially flat. In one embodiment, the slats 152, 154 may incorporate an arcuate shape (e.g., coved, bowed, curved, concave, convex, etc.) so that each of the slats 152, 154 has an arc length (e.g., length measured along the outer surface of the slats from a bottom edge of the slat to the top edge of the slat).

The first and second slats 152, 154 may be coupled to the intermediate piece of material 160 by any means. Similarly, the first slat 152 of a first assembled strip 150 may be coupled to the second slat of a second, adjoining assembled strip 150 via any desired manner known and acceptable to one of ordinary skill in the art. In one embodiment, for example, the first and second slats 152, 154 may be coupled to the intermediate piece of material 160 by an adhesive. Similarly, the first slat 152 may be coupled to the second slat 154 of an adjoining adjacent assembled strip 150 via an adhesive. For example, the adhesive may be specially formulated for sticking to the first and second slats 152, 154, such as aluminum first and second slats 152, 154. The adhesive may be in the form of a curable glue that appropriately cures with temperature and moisture. Alternatively, the curable glue may appropriately cure through atmospheric conditions and time. In one embodiment, the first and second slats 152, 154 may be coupled to the intermediate piece of material 160, and to each other, as a continuous glue line that extends the length of the slats 152, 154. Alternatively, the first and second slats 152, 154 may be coupled to the intermediate piece of material 160, and to each other, by a non-continuous glue line that includes gaps lacking glue. By incorporating a continuous glue line, the assembled strips 150 may have a stiffer construction whereas a more flexible construction may be achieved by incorporating a skipped glue line.

As will be described in greater detail below, the first and second slats 152, 154 may be partially wrapped or covered by the intermediate piece of material 160. Partially wrapping or covering one or more of the slats 152, 154 with the intermediate piece of material 160 gives the assembled covering 106 an added aethestic dimension at the overlapping area between adjoining assembled strips 150. For instance, wrapping the intermediate piece of material 160 about the slat (e.g., a bottom edge of the second slat 154) results in a more uniform appearance than if the slat was not wrapped.

Figure 8:
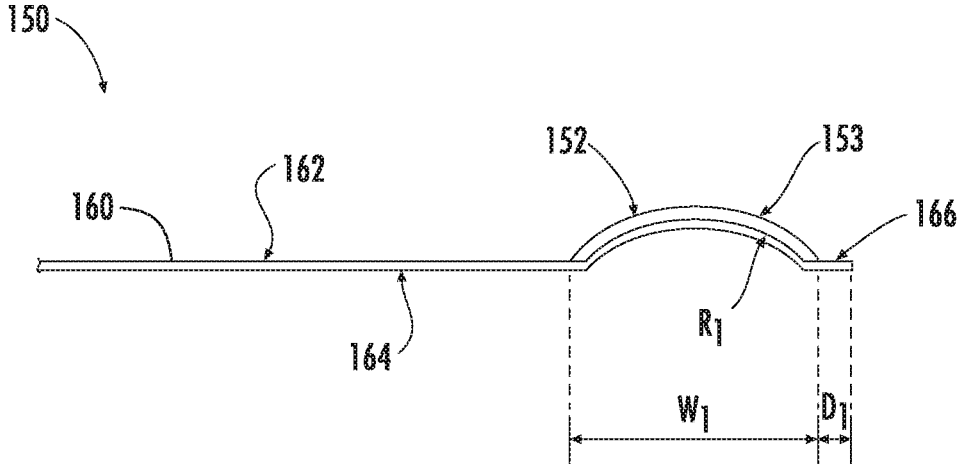
FIG. 8 is a schematic side view illustrating an example embodiment of a first slat coupled to a first end of an intermediate piece of material.
Figure 9:
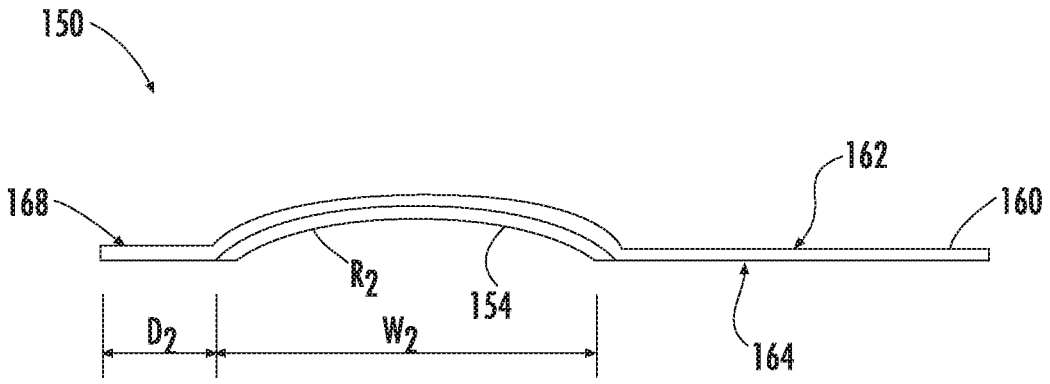
FIG. 9 is a schematic side view illustrating an example embodiment of a second slat coupled to a second end of an intermediate piece of material.
Figure 10:
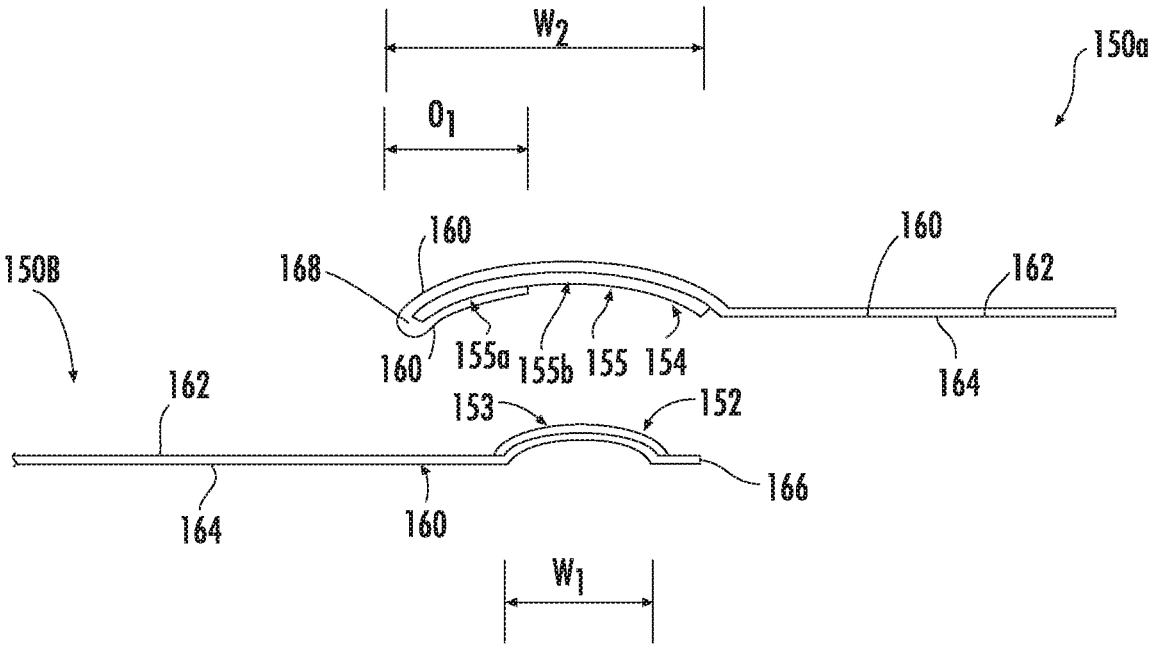
FIG. 10 is a schematic side view illustrating an example embodiment of the first slat nesting with the second slat.

Referring to FIGS. 4, 8, 9 and 10, in one example embodiment, the second slat 154 may be coupled adjacent the bottom end 168 of the intermediate piece of material 160 so that the second slat 154 may be at least partially wrapped by the intermediate piece of material 160. As such, when adjacent assembled strips 150 are assembled together, any exposed or visible edges of the second slat 154 are wrapped in material 160, and thus provide a pleasing aesthetic appearance. As will be described in greater detail below, in one example embodiment, the first slat 152, coupled adjacent the top end 166 of the intermediate piece of material 160, is not partially wrapped by the intermediate piece of material 160 so that the amount of material 160 residing between the nested slats 152, 154 is minimized or completely eliminated. That is, as best shown in FIG. 10, the first slat 152 includes a contact surface 153 that is preferably completely devoid of any fabric material 160 thereon. The second slat 154 includes a contact surface 155, the contact surface 155 of the second slat 154 may be partially wrapped or covered by the intermediate fabric material 160. In use, the contact surface 153 of the first slat 152 may be any surface of the first slat 152 that faces the second slat 154 of an adjoining assembled strip 150 to come together with, touch, interact with, or be in close proximity to the contact surface 155 of the second slat 154. Similarly, the contact surface 155 of the second slat 154 may be any surface of the second slat 154 that faces the first slat 152 of an adjoining assembled strip 150 to come together with, touch, interact with, or be in close proximity to the contact surface 153 of the first slat 152. In this manner, the second slat 154 includes a contact surface 155 that includes a surface portion 155A that is partially wrapped or covered by fabric material 160 and a surface portion 155B that is completely devoid of any fabric material 160 thereon. As a result, in one embodiment, since the contact surface 153 of the first slat 152 is not wrapped or covered by the intermediate piece of material 160, and the contact surface 155 of the second slat 154 includes a surface portion 155A that is partially wrapped by the intermediate piece of material 160, and a surface portion 155B that is not wrapped or covered by the intermediate piece of material 160, the contact surface 153 of the first slat 152 is aligned with and able to directly contact the non-covered portion 155B of the contact surface 155 of the second slat 154 thus minimizing or completely eliminating any material 160 therebetween. That is, the contact surface 153 of the first slat 152 is aligned and configured so that it does not contact or interact with the surface portion 155A of the second slat 154 that is partially wrapped by the intermediate piece of material 160. As such, in the retracted position, the rolled-up diameter of the covering 106 is reduced.

Referring to FIGS. 8 and 9, in one example embodiment the first and second slats 152, 154 may be coupled to the intermediate piece of material 160 at a distance $D_1$ and $D_2$ from the top and bottom ends 166, 168, respectively, so that the remaining material 160 may extend beyond and/or wrap around the first and second slats 152, 154. For example, the first slat 152 may be coupled a distance of $D_1$ of approximately ⅛ inches from the top end 166. Referring to FIG. 9, in one example embodiment, the second slat 154 may be coupled a distance $D_2$ of approximately ⅜ inches from the lower end 168. The intermediate piece of material 160 may have a height extending from the top end 166 to the bottom end 168 of approximately 8 inches. One of ordinary skill in the art will appreciate that these dimensions are exemplary and that other dimensions may be used as appropriate or desired. In addition, one of ordinary skill in the art will appreciate that the wrapping of the material onto one or both of the slats 152, 154 is entirely optional.

The slats 152, 154 may be manufactured from any appropriate material known in the art including, but not limited to, a plastic material, a metal material such as, for example, aluminum, a polycarbonate, a moldable non-woven material, etc. The first and second slats 152, 154 preferably include rounded corners 175 to prevent snagging and injury to a user. In one embodiment, the side edges 170, 172 of the slats 152, 154 may be rounded during the manufacturing process. That is, as will be described in greater detail below, the side edges 170, 172 of the slats 152, 154 may be rounded simultaneously as the slats 152, 154 are being cut to the appropriate or desired length. The side edges 170, 172 of the slats 152, 154 may be rounded and cut by any method now known or hereafter developed. For example, the side edges 170, 172 of the slats 152, 154 may be rounded and cut via an ultrasonic cutter, a die cutter, a laser, a razor, etc. In one embodiment, the slats 152, 154 may be initially coupled to the intermediate piece of material 160 prior to cutting the side edges 170, 172 of the slats 152, 154. In this manner, the slats 152, 154 and the intermediate piece of material 160 (e.g., fabric) may be cut in a single process step that, in addition, to cutting the slats 152, 154 and the intermediate piece of material 160 (e.g., fabric), may also rounds the side edges 170, 172 of the slats 152, 154. In addition, cutting the slats 152, 154 and the intermediate piece of material 160 (e.g., fabric) in a single process step may also provide the added benefit of sealing the side edges 170, 172 of the slats 152, 154 to the intermediate piece of material 160 (e.g., fabric). An improved bond and seal thus may be formed between the side edges 170, 172 of the slats 152, 154 and the intermediate piece of material 160. Alternatively, the sealing the side edges 170, 172 of the slats 152, 154 to the intermediate piece of material 160 (e.g., fabric) may be accomplished in a separate process step. This may be utilized regardless of whether the slats 152, 154 are partially wrapped by the intermediate piece of material 160 (e.g., fabric), or not.

Referring to FIGS. 5-10, the first and second slats 152, 154 may incorporate an arcuate shape (e.g., a curved concave shape) so that each of the first and second slats 152, 154 has an arc length, although it is envisioned that the slats 152, 154 may have other forms including, for example, flat or substantially flat. In one example embodiment, the first and second slats 152, 154 may be provided in first and second sizes, respectively. That is, for example, the first slat 152 may be sized and configured to fit within or nest with the second slat 154. That is, in use, the first and second slats 152, 154 may be arranged and configured to be in contact or close proximity with each other, be in a stacked relationship, or reside within one another to provide the appearance of a single slat. To facilitate the nesting relationship between the first and second slats 152, 154, the first slat 152 may have a slat width $W_1$. The second slat 154 may have a slat width $W_2$, where the slat width $W_2$ is larger than the slat width $W_1$, or vice-versa. In this manner, the first slat 152 of a first assembled strip, for example, assembled strip 150*a*, may be nested with the second slat 154 of a second, adjoining assembled strip, for example, assembled strip 150*b*. In this manner, the nested first and second slats 152, 154 provided the appearance of being a single slat. In one non-limiting embodiment, the first slat 152 may have a slat width $W_1$ of approximately 16 mm while the second slat 154 may have a slat width $W_2$ of approximately 25 mm so that, in use, the first slat 152 may be received and nested with the second slat 154. By incorporating a second slat 154 having a dimension sized to receive and nest with a smaller first slat 152, the first and second slats 152, 154 have the appearance of being a single slat. One of ordinary skill in the art will appreciate that these dimensions are exemplary and that other dimensions may be used.

In one embodiment, the first slat 152 has a radius of curvature $R_1$ and the second slat 154 has a radius of curvature $R_2$. The radius of curvature $R_1$ and the radius of curvature $R_2$ may be substantially similar, although that is not necessary. That is, the internal radius of the larger (e.g., wider) second slat 154 and the external radius of the smaller (e.g., narrower) first slat 152 are preferably equal so that a maximum contact surface between the first and second slats 152, 154 is achieved. In this manner, when joined, a bottom end 168 of a first assembled strip 150*a* may be nested with a top end 166 of a second assembled strip 150*b*. That is, when joined, the first slat 152 of a first assembled strip, for example, assembled strip 150*a*, may be nested with the second slat 154 of a second assembled strip, for example, assembled strip 150*b*. Incorporation of substantially similar radii of curvatures helps facilitate the nested first and second slats 152, 154 having the appearance of being a single slat.

As will be described in greater detail below, by providing a smaller first slat 152 that is capable of being nested with a larger second slat 154, the covering 106 may have a smaller profile, and, in at least one embodiment, under or behind or further from view, the first and second slats 152, 154 have the appearance of being a single slat, or otherwise to reduce or streamline the profile of the two slats 152, 154. For example, the effective diameter of the roller tube 104 and covering 106 is minimized since the covering 106 is better able to be tightly rolled onto the roller 104 resulting in a smaller overall roll-up diameter of the covering 106 about the roller 104, which may be especially important when in the retracted position (e.g., nesting of the first and second slats 152, 154 minimizes the thickness or affect of the pair of adjacent slats. In addition, referring to FIG. 10 and as was previously described, the smaller first slat 152 is preferably not wrapped in material 160 while the larger, second slat 154 is preferably at least partially wrapped or covered by material 160. In this manner, the first slat 152 has an exposed (e.g., non-wrapped) contact surface 153 for interacting with an exposed (e.g., non-wrapped) contact surface 155B on the second slat 154. The intermediate piece of material 160 may overlap the second slat 154 by, for example, a dimension of $O_1$. In this manner, the unwrapped or exposed contact surface 153 of the first slat 152 directly contacts the unwrapped or exposed contact surface 155B of the second slat 154. One of ordinary skill in the art will appreciate that these dimensions are exemplary and that other dimensions may be used.

Figure 11:
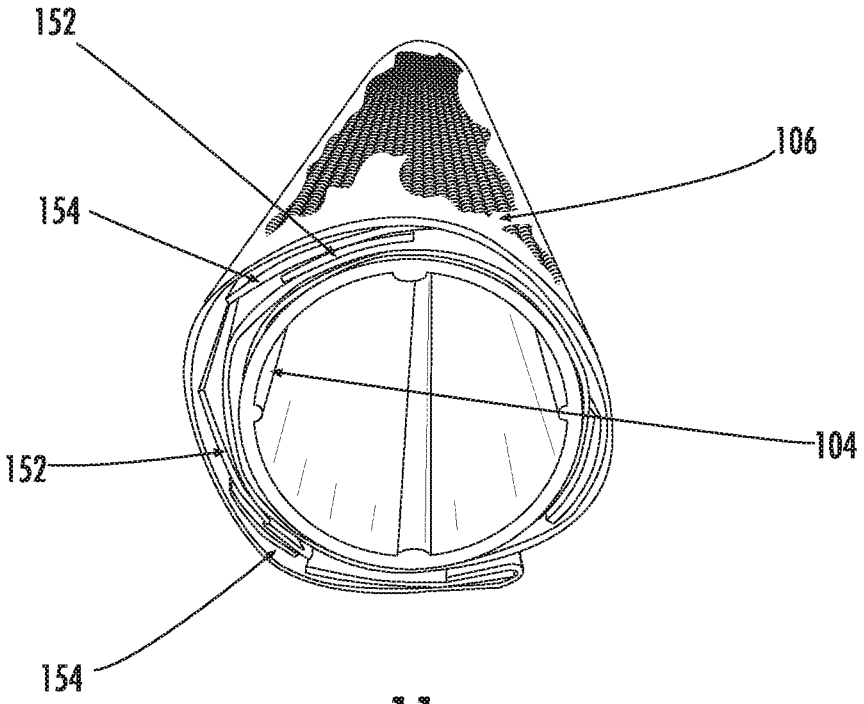
FIG. 11 is a side view illustrating the covering shown in FIG. 2 wrapped around a roller tube.

Manufacturing a covering 106 from a plurality of assembled strips 150 as disclosed herein provides numerous advantages. Referring to FIG. 11, due to the nested configuration of adjoining assembled strips 150*a*, 150*b*, the covering 106 is better able to conform to the roller tube 104. Moreover, by adjusting the diameter of the roller tube 104 as compared to the height (e.g., distance from top end 166 to bottom end 168 of the material 160) of the assembled strips 150 one can ensure that the nested first and second slats 152, 154 will be off-set from one another. This enables the covering 106, in the retracted position, to have a reduced profile (e.g., a reduced diameter).

Moreover, manufacturing a covering 106 via assembled strips 150 facilitates construction via an automated, production-on-demand methodology. That is, because the assembled strips 150 can be manufactured in a uniform manner and size, assembled strips 150 can be mass-produced in a uniform, repeatable process and then assembled together as needed to meet the requirements and/or sizes of the particular application. For example, machinery can be setup to receive material from a large (e.g., multiple windings of material) roll, cut the material into specified width and height, and couple the first and second slats to the material covering in an automated fashion. In one embodiment, a method of manufacturing a covering 106 may include feeding the intermediate strip of material 160 into machinery, for example, production-on-demand type equipment. The machinery may unwrap and cut the intermediate strip of material 160 to its appropriate size. The first and second slats 152, 154 may be fed into the machinery where the first and second slats 152, 154 may be coupled to the intermediate strip of material 160. The first and second slats 152, 154 and the intermediate strip of material 160 may be fed into the machinery where the first and second slats 152, 154 are coupled to the intermediate strip of material 160, and where the first and second slats 152, 154 and the intermediate strip of material 160 are cut in a single step. In one embodiment, an adhesive may be applied to the intermediate strip of material 160 and/or the first and second slats 152, 154 for coupling the first and second slats 152, 154 to the intermediate strip of material 160 prior to cutting the first and second slats 152, 154, and optionally the intermediate strip of material 160.

As previously described, in one embodiment, after being coupled to the intermediate strip of material 160, the side edges 170, 172 of the slats 152, 154 may be cut and rounded simultaneously with the cutting of the first and second slats 152, 154 and the intermediate piece of material 160 (e.g., fabric). That is, by cutting and rounding the side edges 170, 172 of the slats 152, 154 and the intermediate strip of material 160, the manufacturing process is much more efficient. In addition, cutting the slats 152, 154 and the intermediate piece of material 160 (e.g., fabric) in a single process step may also provide the added benefit of sealing the side edges 170, 172 of the slats 152, 154 to the intermediate piece of material 160 (e.g., fabric). Alternatively, as previously mentioned, the intermediate strip of material 160 and the slats 152, 154 may be cut in separate manufacturing steps. In addition, the side edges 170, 172 of the slats 152, 154 may be rounded in a separate manufacturing process step, and the side edges 170, 172 of the slats 152, 154 may be sealed to the intermediate strip of material 160 in separate manufacturing steps.

In one embodiment, the first and second slats 152, 154 made be formed to include an arcuate profile prior to feeding the first and second slats 152, 154 into the machinery and coupling the slats 152, 154 to the intermediate strip of material 160. Alternatively, the first and second slats 152, 154 may be coupled to the intermediate strip of material 160 and then the arcuate profile may be formed into the first and second slats 152, 154. The arcuate profile may be formed by any mechanism now known or hereafter developed. For example, the arcuate profile in the slats 152, 154 may be formed by bending where the slats 152, 154 are formed from a metal material (e.g., aluminum slats). Alternatively, the arcuate profile in the slats 152, 154 may be formed by heating and compressing the slats 152, 154 where the slats are formed from a polymeric material.

Finally, a desired number of assembled strips 150 may be coupled to one another by coupling the respective slats, such as by coupling the contact surface 153 of the first slat 152 with the contact surface 155 of (or the surface portion 155B of the contact surface 155 depending on whether the second slat 153 is partially wrapped or not) of the second slat 154 of an adjoining, second assembled strip 150. Alternatively, in one embodiment, the flat or substantially flat, polymeric first and second slats 152, 154 may be coupled to the intermediate strip of material 160 and adjacent assembled strips 150 may be coupled to one another to form the covering 106. The covering 106 may then be rolled about a roller, for example the head rail 108, to mechanically conform a shape of the slats 152, 154 to a radius of curvature defined at least partially by the roller. Heat may then be applied to raise the temperature of the slats 152, 154 above the softening point of the slats 152, 154 (e.g., polymeric first and second slats 152, 154). As the slats 152, 154 are softened, the resiliency of the slats 152, 154 to return to a flat configuration may be removed such that the slats 152, 154 may maintain the curvature corresponding to the radius of curvature of the roller and the inner windings of the covering 106. In some implementations, the slats 152, 154 are heated to above the softening point. For example, in connection with the polymeric slats 152, 154, the slats 152, 154 may be heated to a temperature of about 180 degrees Fahrenheit, which may be between about 10 degrees and about 15 degrees Fahrenheit above the softening point) of the material of the slats 152, 154, and held at that temperature for a time of about 1 hour. One of ordinary skill in the art will appreciate that these temperature ranges are exemplary and that other temperatures ranges may be used depending on the material used for the slats 152, 154.

After the slats 152, 154 are conformed to their respective profiles and with the covering 106 is still wrapped about the roller, the combination of the fabric, the slats, and the adhesive may be cooled below the softening point of the slats 152, 154 to set the curvature of all of the slats 152, 154 to a coved or curved profile matching the combined diameter of the roller and the rolled-up portion of the covering 106 at the respective slats 152, 154 position on the covering 106. In other words, the slats 152, 154 positioned closer to the lower edge of the covering 106 may have a larger radius of curvature than the slats 152, 154 positioned closer to the upper edge of the covering 106. Stated differently, the radius of curvature of the slats 152, 154 may increase from the upper edge of the covering 106 to the lower edge of the covering 106 to provide the tightest roll up diameter of the covering 106 about the roller.

Utilizing a strip method of fabrication as described herein also minimizes material waste. Utilizing the assembled strips 150, allows one to receive a strip of material 160, cut it to the desired width (e.g., length of the strip of material equals the width of the assembled strip) with very minimal waste. Moreover, generally speaking, if purchased material has a stain or tear, under conventional methodology, the entire piece of material is generally discarded. However, in accordance with the present disclosure, since the covering is manufactured from smaller pieces of assembled strips 150, only the defective portion of the material needs to be discarded, thus minimizing the amount of waste.

In addition, by using a strip method of fabrication, material that is normally not readily available in larger widths, or that may be too soft or too flexible to be used to make larger coverings can be utilized (e.g., material that tends to wrinkle cannot generally be extended greater than a certain width and thus cannot be used in relatively wide dimensions such as, for example, greater than 54 inches). As such, generally speaking, delicate or soft materials may only be available in sizes up to about 54". Thus, use of delicate materials in covering manufacturing is generally limited to coverings having a width of less than 54". By utilizing the assembled strips 150 in accordance with the present disclosure however, delicate fabrics can be used to manufacture wider coverings since the material can be used to manufacture the assembled strips 150, which can then be joined together. For instance, in one embodiment, the material is rolled in shorter widths (e.g., height of assembled strips 150). In use, the unwound length of material is used to extend across the width of the covering 106 (e.g., the width of the covering 106 now becomes the height of the assembled strips 150). First and second slats 152, 154 may be coupled to the material 160 forming the assembled strips 150. Thereafter, the assembled strips 150 may be coupled together to achieve the specified or desired height of the covering 106. In use, the slats 152, 154 add stability to otherwise non-self-supporting material so that delicate materials can now be extended to form wider coverings 106. The material may be cut from a roll of material to any desired length which is sized to extend across the width of the covering. The length of the covering may then be customizable by increasing or decreasing the number of assembled strips 150 joined together, or by varying the height of each assembled strip 150.

In addition, by nesting slats from adjacent, adjoining assembled strips 150, the covering 106 has increased rigidity thus enabling the use of materials that would otherwise be too soft or too flexible to be used to make larger coverings. The slats 152, 154 also provide increased structure or rigidity across the width of the covering 106 to prevent wrinkling of the material across the length of the covering 106. For example, as would be readily appreciated by one of ordinary skill in the art, the incorporation of coved strips may readily increase stiffness or rigidity of the covering.

Furthermore, in use, the first and second slats 152, 154 may function as stiffening members. That is, the first and second slats 152, 154 may stiffen the lateral edges of the intermediate piece of material 160 to prevent or substantially prevent the lateral edges of the intermediate piece of material 160 from curling when the intermediate piece of material 160 is extended from the roller tube 104. As such, the first and second slats 152, 154 may enable the use of softer or more flexible or thinner fabrics that would not otherwise be suitable for use. By incorporating the first and second slats 152, 154, the intermediate piece of material 160 is strengthened so that softer or more flexible or thinner fabrics can be used without having the fabric bow at each end thereof or sagging from top to bottom. In addition, the first and second slats 152, 154 may reduce or substantially prevent wrinkling, induced by a deflecting or sagging roller tube or just the effect of the extent of the fabric across the width of the covering (e.g., sagging), from projecting downwardly along the length of the intermediate piece of material 160, which may enable the use of a smaller outer diameter roller and/or a longer roller.

This method also lends itself to producing many varieties of coverings, such as from those with high view-through, to room-darkening coverings, to those with insulating properties, by modifying the material or adding another piece of material. For example, the method according to the present disclosure may lend itself to the manufacturing of combi/Zebra/banded style window covering material that use alternating translucent and opaque material.

While the present disclosure makes reference to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The foregoing description has broad application. It should be appreciated that the concepts disclosed herein may apply to many types of coverings, in addition to the roller-type coverings described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

The invention claimed is:

1. A covering for an architectural-structure covering comprising:

a plurality of assembled strips of fabric material joined together, each assembled strip of fabric material including:

a fabric material including an inner surface, an outer surface, a top end, a bottom end, a first side edge, and a second side edge;

a first slat coupled to said inner surface of said fabric material adjacent said top end thereof, said first slat having a first contact surface; and a second slat coupled to said outer surface of said fabric material adjacent said bottom end thereof, said second slat having a second contact surface;

wherein said first contact surface of said first slat of a first assembled strip of fabric material is nested with said second contact surface of said second slat of an adjoining second assembled strip of fabric material; and wherein each of said first slats has a width $W_1$ and each of said second slats has a width $W_2$, $W_2$ being larger than $W_1$, each of said widths of said slats being measured from a bottom edge of said slat to a top edge of said slat.

2. The covering of claim 1, wherein said bottom edge of said second slat is covered by said fabric material.

3. The covering of claim 1, wherein each of said second slats is at least partially wrapped by its respective fabric material thus forming a surface at least partially covered by said fabric material, a remaining, non-covered portion of said surface defining said second contact surface.

4. The covering of claim 3, wherein each of said first slats is coupled to said inner surface of said fabric material a distance $D_1$ from said top end, and each of said second slats is coupled to said outer surface of said fabric material a distance $D_2$ from said bottom end, wherein $D_2$ is different than $D_1$.

5. The covering of claim 1, wherein each of said first and second slats include an arcuate shape so that each of said first and second slats has an arc length.

6. The covering of claim 5, wherein each of said first slats has a radius of curvature $R_1$ and each of the second slats has a radius of curvature $R_2$, $R_1$ being substantially equal to $R_2$.

7. The covering of claim 1, wherein each of said first and second slats extends from the first side edge to the second side edge of said fabric material.

8. The covering of claim 1, wherein each of said first and second slats includes rounded corners.

9. An assembled strip of material for use in producing an architectural-structure covering, the assembled strip of material comprising:

a fabric material including an inner surface, an outer surface, a top end, a bottom end, a first side edge, and a second side edge;

a first slat coupled to said inner surface of said fabric material adjacent said top end thereof, said first slat having a first contact surface; and a second slat coupled to said outer surface of said fabric material adjacent said bottom end thereof, said second slat having a second contact surface configured to contact said first contact surface of an adjacent assembled strip;

wherein said first slat has a width $W_1$ and said second slat has a width $W_2$, $W_2$ being larger than $W_1$, each of said widths of said slats being measured from a bottom edge of said slat to a top edge of said slat.

10. The assembled strip of claim 9, wherein, in use, said first slat is arranged to nest with said second slat.

11. The assembled strip of claim 9, wherein said first slat has a radius of curvature $R_1$ and said second slat has a radius of curvature $R_2$, $R_1$ being substantially equal to $R_2$.

12. The assembled strip of claim 9, wherein said first and second slats function as stiffening members to minimize curling of the first and second side edges of said fabric material.

13. The assembled strip of claim 9, wherein said first and second slats provide increased rigidity to said fabric material to prevent wrinkling of said fabric material.

* * * * *